United States Patent [19]

Custer, Jr. et al.

[11] 4,214,328

[45] Jul. 29, 1980

[54] SUSPENDED PROTECTIVE SHEETS

[76] Inventors: Byron K. Custer, Jr.; Ruth M. Custer, both of 725 Parkview Dr., Johnstown, Pa. 15905

[21] Appl. No.: 6,465

[22] Filed: Jan. 25, 1979

[51] Int. Cl.[2] ..... A47G 23/00

[52] U.S. Cl. ..... 5/494; 5/424

[58] Field of Search ..... 5/97, 424, 425, 460, 5/482, 486, 494–497

[56] References Cited

U.S. PATENT DOCUMENTS

| | | | |
|---|---|---|---|
| 3,134,110 | 5/1964 | Gamichon | 5/494 |
| 3,145,396 | 8/1964 | Zindell | 5/97 |
| 3,535,719 | 10/1970 | Murcott | 5/424 |
| 4,074,375 | 2/1978 | Kella | 5/494 |

*Primary Examiner*—Casmir A. Nunberg
*Attorney, Agent, or Firm*—Jon M. Lewis

[57] ABSTRACT

A restraining device completely encircles a person's torso beneath his underarms and then is firmly anchored to the mattress or bedframe. The restraining device is made from a top and bottom sheet releaseably fastened together along mating ends which when fastened form an opening for encircling a person's torso. The head end of the top sheet is arranged with a pocket or other means of attachment of a panel of semi-rigid material to prevent a person from effectively grasping anything beneath the top sheet. The top sheet is suspended over the bed surface by elastic straps extending over and fastened to the side rails of the bed.

20 Claims, 6 Drawing Figures

SUSPENDED PROTECTIVE SHEETS

FIELD OF INVENTION

This invention has to do with a method of restraint and restraining devices for beds and is especially concerned with the gentle restraint and prevention of certain activities of patients in hospital beds.

BACKGROUND OF THE INVENTION

Restraint devices for beds are necessary to prevent a person from either subconsciously or consciously injuring themselves by movement or other activity. Patients in hospitals are especially concerned with the problem in that when tubes or dressings are attached to the body only minimal movement may take place in order to avoid accidentally pulling tubes or dressings from afflicted areas. Further, there are patients that will attempt to remove the tubes or dressings when unattended by hospital personnel due to seemingly unbearable discomfort.

Prior art devices have generally been unsatisfactory in that while restricting movement of the body they have also severely restricted movement of either the arms or legs or both and have too added to the patient's discomfort. Prior devices have also not been practical in allowing hospital personnel such as doctors and nurses easy access to the patient's body for treatment or bathing and further have not themselves been easily removeable for cleaning purposes.

Examples of prior art restraining devices or devices that attempt to enhance the comfort of a person lying in a bed may be had by reference to the following U.S. Pat. Nos.: 2,683,267; 787,848; 2,695,414; 2,912,977; 1,368,582; 1,426,230; 3,344,446; 1,001,088; 921,439; and 3,535,718. Most pertinent among these prior art patents are U.S. Pat. Nos. 921,439 and 3,344,446.

U.S. Pat. No. 921,439 describes a crib cover for restraint of an infant. The crib cover, however, restrains the movement of the infant's arms, legs, and torso with a cover that encircles the infant's neck to achieve the inventor's goal. In cases of patients in hospital beds the restraint of movement of the arms and legs can cause discomfort and in cases of infants there is a question of safety when the infant's neck is encircled by the cover.

U.S. Pat. No. 3,344,446 has to do with an orthopedic bed covering that is used on a patient having a leg in traction. The intent of the patent is to provide a covering for the patient's lower body portions and also to permit easy access to the legs in traction. Restraint of movement is not the problem intended to be solved by the inventor described in U.S. Pat. No. 3,344,446.

It is an object of the present invention to provide a method of restraining a person's movement in a bed that allows movement of the person's arms and legs while gently restraining the person's torso.

It is an object of the present invention to provide a device that will effectively restrain movement of a person in a bed and will do so in a most comfortable manner.

It is a further object of the present invention to provide a device for restraining a patient's movement in a bed and to provide ease of access to the patient for routine hospital procedures.

It is a further object of the present invention to prevent a person from being able to grasp anything between a top and bottom sheet while allowing free movement of the arms and hands.

It is a further object of the present invention to provide a restraining system that is simple, efficient, easily assembled and disassembled and provides a maximum of comfort for the person or patient.

BRIEF SUMMARY OF THE INVENTION

According to the present invention a method of restraining a person comprises completely and closely encircling a person's torso beneath the underarms with an article and then anchoring the article to a bed. The article is preferably made from the mating ends of a top and bottom sheet having co-operating elements of releaseable fastener means, preferably velcro fasteners, on said ends. The mating ends of the sheets are placed around a person's torso just below his underarms and fastened on both sides of the person. Either one or both of the ends of top and bottom sheets can then be anchored to the bed to restrict the person's movement.

When on the bed the sheet has a section that extends away from the mating ends toward the foot of the bed in which a material, preferably a semi-rigid material can be placed so as to prevent a person from grasping anything beneath the top sheet or between the top and bottom sheets. The semi-rigid material may be attached to the top sheet by buttons, snaps or other fastening devices; or a pocket may be provided for insertion of the semi-rigid material.

In order to provide comfort for patients in beds the top sheet has a portion that extends towards the foot of the bed that is suspended above the bed surface by at least 12 inches but not so high that the top sheet becomes ineffective in providing warmth and comfort for the patient.

The suspended portion of the sheet is supported by elastic cords that are fastened to the side rails of a hospital bed and extend over an uppermost rail of the side rail to support the portion. Preferably when the side rail of a hospital bed comprises a top, bottom, and middle rail the elastic cords can be releaseably attached to the middle rail extend or stretched down under the bottom rail and extend up and over the top rail and be releasably attached to the suspended portion of the sheet.

The invention further contemplates a bottom sheet for a bed which comprises a sheet that can be a draw sheet or any sheet having at least three sides or ends that can be fastened to a bed with one of the ends extending across the head of the bed. Strings on the bottom sheet can be used to firmly tie the bottom sheet to the bed and the one end extending across the bed should have a releaseable fastening means fixed thereon, preferably a velcro fastener. The one end with the fastener must be able to mate with an end on a second sheet so as to closely encircle a person's torso beneath his underarms.

The invention further contemplates a top sheet for a bed which comprises a sheet having at least three angularly related sides or ends with one end having a releaseable fastening means for fastening to an end of another sheet while closely and completely encircling a person's torso beneath the underarms. The top sheet further preferably comprises the above mentioned means of attaching a semi-rigid mesh material and further has reinforced fabric area spaced along the sides of the suspended portion of the sheet. Placed on the reinforced areas of the suspended portion are suspension loops that can be attached to any type of suspension device that may be used but preferably the stretched ends of an elastic cord.

DETAILED DESCRIPTION OF THE DRAWINGS

Figure 1:
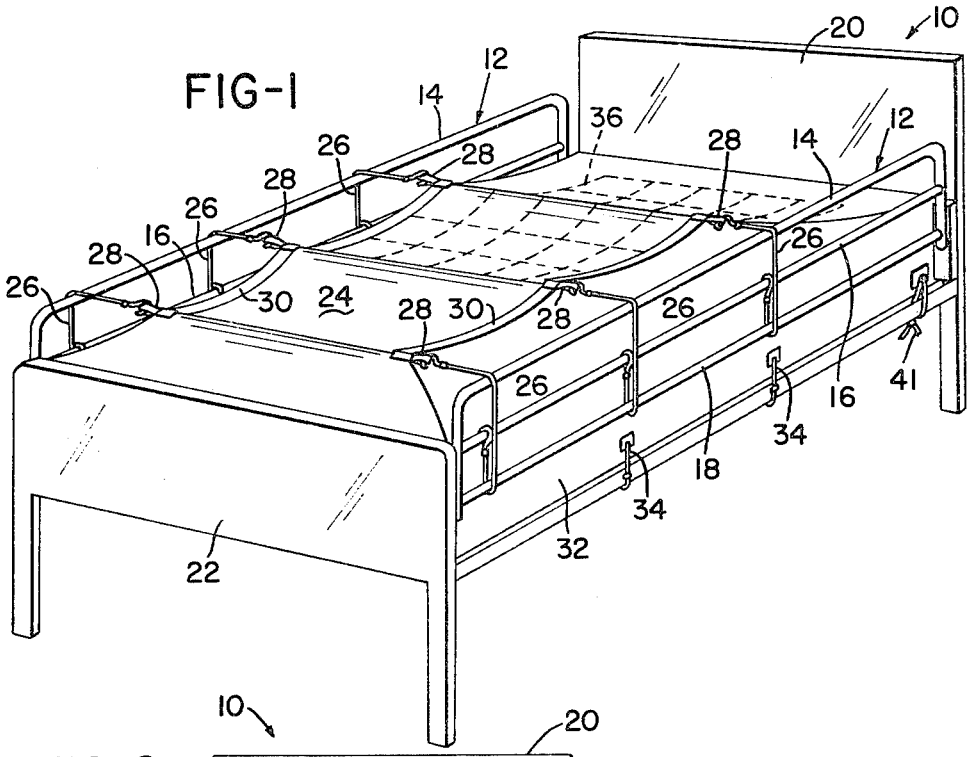
FIG. 1 is a perspective view of a bed equipped with a restraining and suspension device according to the present invention.
Figure 2:
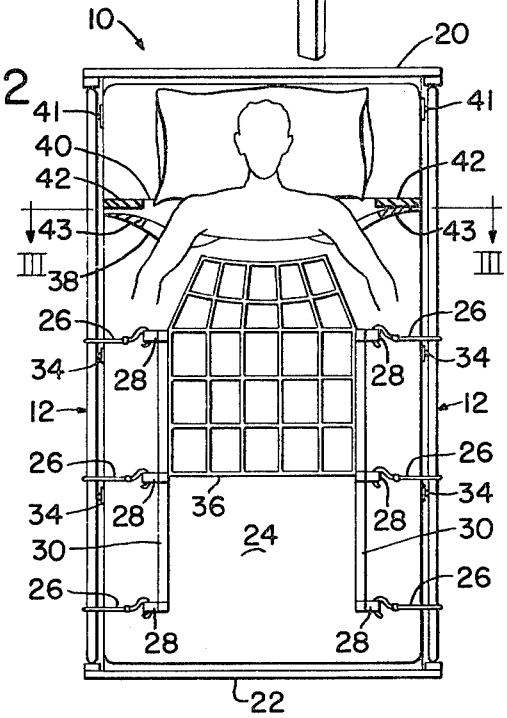
FIG. 2 is a top view of a bed having a person therein with a restraining device according to the present invention.
Figure 3:
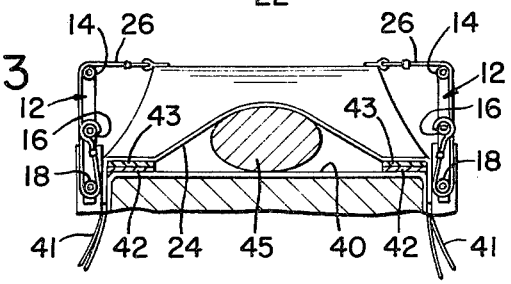
FIG. 3 is a cross sectional view thru Section III—III of FIG. 2.
Figure 4:
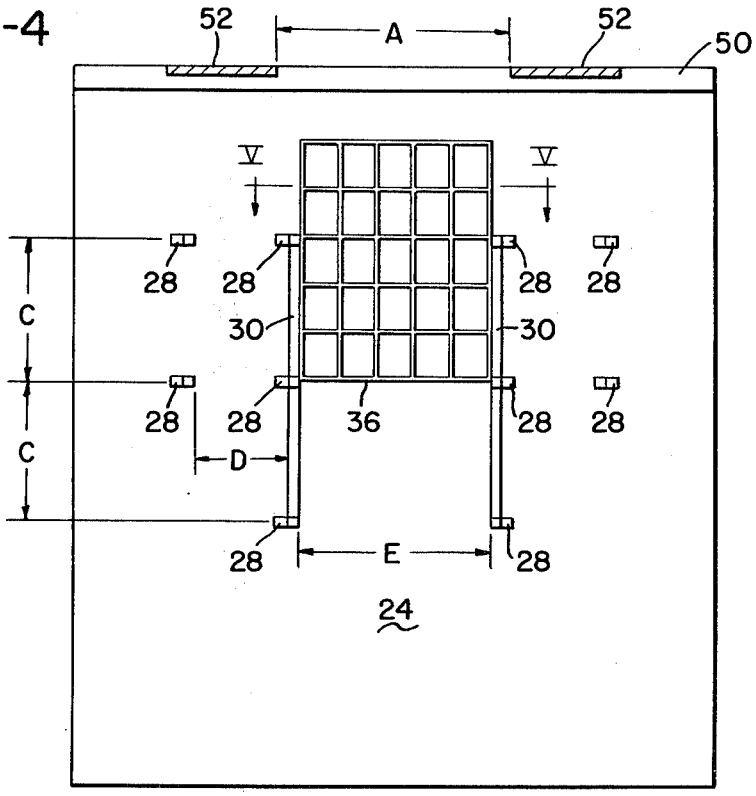
FIG. 4 is a top sheet according to the present invention.
Figure 5:
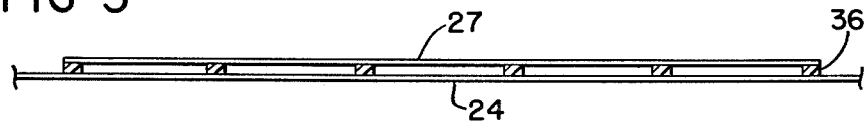
FIG. 5 is a sectional view thru V—V of FIG. 4.
Figure 6:
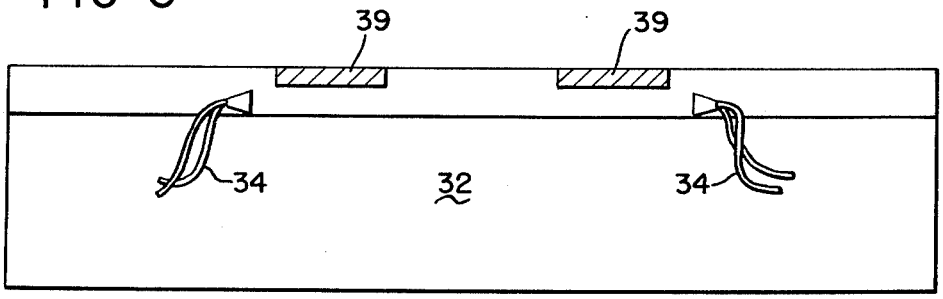
FIG. 6 is a bottom sheet according to the present invention.

Referring to FIG. 1 what is shown therein is a bed 10 having side rails 12. Side rails 12 will usually be comprised of a top rail 14, an intermediate or middle rail 16, and a bottom rail 18. The bed has a headboard 20 and footboard 22. As can be seen in FIG. 1 a top sheet 24 has a portion suspended above the surface of the bed by elastic straps 26 shown on both sides of the bed. The elastic straps 26 are shown having releaseable fastening means, such as hooks that are attached to loops 28 that are spaced along the sides of the top sheet 24. The loops on 28 are preferably located on a reinforced region 30 that is attached to top sheet 24 so that it may be suspended above the bed. The reinforcement region 30 is placed along both sides of the sheets and loops 28 are then attached to the reinforced region. The elastic straps 26 are shown in FIG. 1 preferably extending over the top rail 14 of the side rail 12 and extend down and under the bottom rail 18, the straps 26 are then fastened to the middle rail 16 of the side rail 12. Shown also in FIG. 1 is a portion of a bottom sheet 32 having tie down straps 34 that extend from the sheet 32 and extend down and are fastened to the mattress or frame of bed 10. Referring now to FIG. 2 shown therein is a plain view of the bed of FIG. 1 having a patient or person on the bed surface. The suspensions straps 26 can be seen extending over and being attached to the loops 28 on the top sheet 24. The top sheet 24 is shown having a section near the head end of the bed that is equipped with a semi-rigid material 36 which is preferably a palstic mesh that can be attached to or sewn in the section of the top sheet 24. Top sheet 24 then has a portion that is suspended above the bed surface by approximately 12 inches or more and that can include the section having semi-rigid material along with the section that extends from the head of the bed 20 to the foot of the bed 22. Shown along the top portion of the bed are the mating ends of the top and bottom sheet mating being designated as 38 and 40 respectively. The mating ends 38 and 40 have fastened thereon a releaseably fastening means 42 which is shown in FIG. 2 by the top sheet having its flap laid back so as to show the releaseable fastener means 42. The releaseable fastener means is on both sides of the patient or person that occupies the bed with the mating ends fastening together so that they closely and completely surround the person's torso just below the person's underarms. By closely and completely encircling the person's torso what is meant is that the opening fitting around the person's body will not be so tight as to make it uncomfortable for the patient, however, it should not be so loose that the person would have unnecessary freedom of movement with his torso upon the bed surface. Shown in FIG. 3 is a cross sectional view of the invention thru section III—III of FIG. 2. Shown therein is a top sheet 24 and a bottom sheet 32. The bottom sheet 32 has straps 41 for fastening to a mattress or bedframe and has a releaseable fastener means 42 shown on either side of the bottom sheet. The top sheet 24 also has the releaseable fastening means 43 shown and having its ends meet with the ends of the bottom sheet 40. A torso 45 has the sheet fitting around the main part of the trunk body and it can be seen at the ends 41 and 42 releaseably mate so as to closely and completely encircle the torso 45. Referring now to FIG. 4 shown here is a top sheet containing a preferred embodiment of the present invention. The top sheet is made from the regular sheet but has reinforcement regions 30 placed thereon in the form of strips of plastic mesh. Suspension loops 28 have been placed both on the reinforcement region 30 and also along the sides of the sheet. The reinforcement loops are to be spaced along the sides of the sheet as necessary so as to fit the configuration of the side rails of the particular bed. The elastic straps 26 with the hooks would then mate with the loops and suspend the sheet from the side rail. Shown in FIG. 4 is the heading 50 of a top sheet with a side or end 50 having velcro type fasteners 52 mounted thereon. The velcro type fasteners are preferably spaced approximately 25 inches apart, the 25 inches dimension indicated at "a" with the preferred embodiment being dimensioned at approximately 12 inches. The top sheet 24 has a semi-rigid material 36 placed in a section of the sheet near the heading. The material preferably a plastic mesh is selected to prevent a person's hand from effectively grasping any object thru the sheet. The semi-rigid material when mated with the sheet forms a semi-rigid section of the sheet which may be a part of the portion which is suspended with the rest of the sheet and that extends toward the footboard 22. Referring to the dimension indicated at "c" 18 inches is the preferred distance between the loops 28 although different beds and equipment could cause this dimension to vary. The semi-rigid plastic section is given as spaced approximately 10 inches on the inside of the outer most suspension loop 28 and having a section approximately 20 inches wide as shown by dimensions D and E in FIG. 4. Referring now to FIG. 5 what is shown therein is a sectional view of V—V thru section 4 demonstrating that the semi-rigid material may be contained in a pocket formed on the top sheet 24. Another sheet section 27 is fastened to the top sheet 24 so that a pocket is formed between the sheets 27 and 24. The semi-rigid plastic material 36 is shown inserted in the pocket of the sheet and then may be removed when desired thru the opening of this pocket. The opening of the pocket of the sheets 27 and 24 is preferably located nearest the footboard end of the bed but could also be on any other sides of the top sheet. What is shown in FIG. 6 is a bottom sheet 32 according to the present invention. A standard sheet is selected, and attached to the standard sheet are strings or straps 34 that are for extending under a mattress or the bedframe in order to attach and hold the bottom sheet 32 releaseable fastener means 39 is attached across the one side or edge. The releaseable fastener means is preferably a velcro type fastener, however, the top and bottom sheets can also be attached with zipper, snaps, safety pins, etc. The releaseable fastener when placed on the side must be able to mate with the mating end of the top sheet such that when fastened an opening for encircling a person's torso is provided as described above.

Having fully described my invention it is to be understood that the form of the invention herewith shown and described is to be taken as a preferred example and that various changes in shape, size, fastener means, etc., may be resorted to without departing from the spirit of the invention and that modification may be made within the scope of the appended claims.

I claim:

1. A restraining device which comprises
a. a fabric band
b. means for anchoring said fabric band to a bed
c. a top sheet for laying over said fabric band
d. mating ends on said top sheet and fabric band
e. releasable fastener means on said ends that when fastened will define an opening for closely and completely encircling a person's torso beneath the underarms
f. means for suspending a portion of said top sheet a spaced distance above said fabric band
g. a section of said top sheet that extends away from said mating ends
h. means in said section for preventing a person's hand from grasping anything between said top and bottom sheets which comprises
i. another sheet mating with said section to form
j. a pocket and
k. a semi-rigid material insertable into said pocket.

2. A restraining device according to claim 1 which further comprises
a. a section of said top sheet that extends away from said mating end
b. means in said section for preventing a person's hand from grasping anything between said top and bottom sheets.

3. A restraining device according to claim 2 in which said means for preventing a person's hand from grasping anything between said top and bottom sheets comprises
a. another sheet mating with said section to form
b. a pocket, and
c. a semi-rigid material insertable into said pocket.

4. A restraining device according to claim 1 in which said means for suspending said portion a spaced distance above said bottom sheet comprises
a. a bed
b. a bed surface
c. side rails on said bed extending at least 12" above said bed surface
d. elastic cords releaseably attached to said side rails and stretched over the tops of said rails to support said portion.

5. A restraining device according to claim 4 which further comprises
a. reinforced regions on said portion
b. loops on said reinforced regions
c. releaseable means of attachment between said elastic cords and said loops.

6. A restraining device according to claim 5 which further comprises
a. a bottom, middle and top rail on said side rail
b. one of said elastic cords attached to said middle rail, said cord extending under said bottom rail and over said top rail, and releaseably attached to a loop on said portion.

7. A method of restraining a person in a bed which comprises the steps of
a. taking top and bottom sheets having ends that can be releaseably fastened together
b. completely and closely encircling the ends around a person's torso beneath his underarms
c. fastening the ends together
d. anchoring at least one of the top and bottom sheets to a bed
e. suspending the top sheet a spaced distance above the bottom sheet
f. joining a semi-rigid material to a section of the top sheet so as to prevent a person from grasping anything between the sections of the top sheet and the bottom sheet.

8. The method according to claim 7 which further includes the step of
a. suspending a portion of the top sheet at least 12" above the bottom sheet.

9. A bottom sheet for a bed which comprises
a. a sheet having at least three angularly related ends
b. means on said sheet for firmly fastening said sheet to a bed
c. releaseable fastener means on one of said ends so that when fastened to another sheet will define an opening for closely and completely encircling a person's torso beneath his underarms.

10. A bottom sheet according to claim 9 in which said releaseable fastening means comprises
a. a velcro fastener extending along said end.

11. A top sheet for a bed which comprises:
a. a first sheet having at least three angularly related ends
b. releasable fastener means on one of said ends that when fastened to a second sheet will define an opening for completely and closely encircling a person's torso beneath the underarms, and
c. a semi-rigid material joined with said first sheet so as to prevent a person's hand from grasping anything between said first and second sheets.

12. A top sheet according to claim 11 in which said releaseable fastening means comprises
a. a velcro fastener extending along said end.

13. A top sheet according to claim 11 which further comprises
a. another sheet mating with said top sheet to form a
b. pocket, said pocket sized so as to allow insertion of said semi-rigid material.

14. A top sheet according to claim 11 which further comprises
a. reinforced fabric areas spaced along the sides of said sheets and
b. suspension loops attached to said reinforced region.

15. A top sheet according to claim 13 which further comprises
a. reinforced fabric areas spaced along the sides of said sheet
b. suspension loops attached to said reinforced region.

16. A restraining device which comprises:
a. a bottom sheet or fabric band
b. means for anchoring said fabric band to a bed
c. a top sheet for laying over said fabric band
d. mating ends on said fabric band and top sheet
e. releasable fastener means or said ends that when fastened will define an opening for closely and completely encircling a person's torso beneath the underarms f. means for suspending a portion of said top sheet above said fabric band and a section of said top sheet extending away from said mating end having means therein for preventing a person's hand from grasping anything between said fabric band on said top sheet.

17. A restraining device according to claim 16 in which said means for preventing a person's hand from grasping anything between said top and bottom sheets comprises a. another sheet mating with said section to form b. a pocket, and c. a semi-rigid material insertable into said pocket.

18. A restraining device according to claim 17 in which said means for suspending said portion a spaced distance above said bottom sheet comprises a. a bed b. a bed surface c. slide rails on said bed extending at least twelve inches above said bed surface d. elastic cords releaseably attached to said side rails and stretched over the tops of said rails to support said portion.

19. A restraining device according to claim 18 which further comprises a. reinforced regions on said portion b. loops on said reinforced regions c. releaseable means of attachment between said elastic cords and said loops.

20. A restraining device according to claim 18 which further comprises a. a bottom, middle and top rail on said side rail b. one of said elastic cords attached to said middle rail, said cord extending under said bottom rail and over said top rail, and releaseably attached to a loop on said portion.

* * * * *